United States Patent [19]

Runser

[11] Patent Number: 5,076,075

[45] Date of Patent: Dec. 31, 1991

[54] INSTALLATION FOR HEAT-SETTING OF TEXTILE YARNS, HAVING TWO STEAM HEAT-TREATMENT CHAMBERS

[75] Inventor: Henri Runser, Pfastatt, France

[73] Assignee: Passap S.A., Mulhouse, France

[21] Appl. No.: 618,377

[22] Filed: Nov. 27, 1990

[30] Foreign Application Priority Data

Nov. 29, 1989 [FI] Finland ..... 89 15720

[51] Int. Cl.[5] ..... D06B 3/06

[52] U.S. Cl. ..... 68/5

[58] Field of Search ..... 68/5 D, 5 E; 28/281

[56] References Cited

FOREIGN PATENT DOCUMENTS 2447414 8/1980 France .
2478150 9/1981 France .
2013257 8/1979 United Kingdom .

*Primary Examiner*—Philip R. Coe
*Attorney, Agent, or Firm*—Young & Thompson

[57] ABSTRACT

The installation comprises two identical heat-setting chambers (1, 2). The chambers (1, 2) are connected to each other by way of ducts (8, 8*a*) through which the steam extracted from inside one of the chambers is delivered to the other chamber, so as to mix the steam. Use for increasing productivity and obtaining yarns treated under identical conditions by two separate installations.

3 Claims, 1 Drawing Sheet

Figure 1:
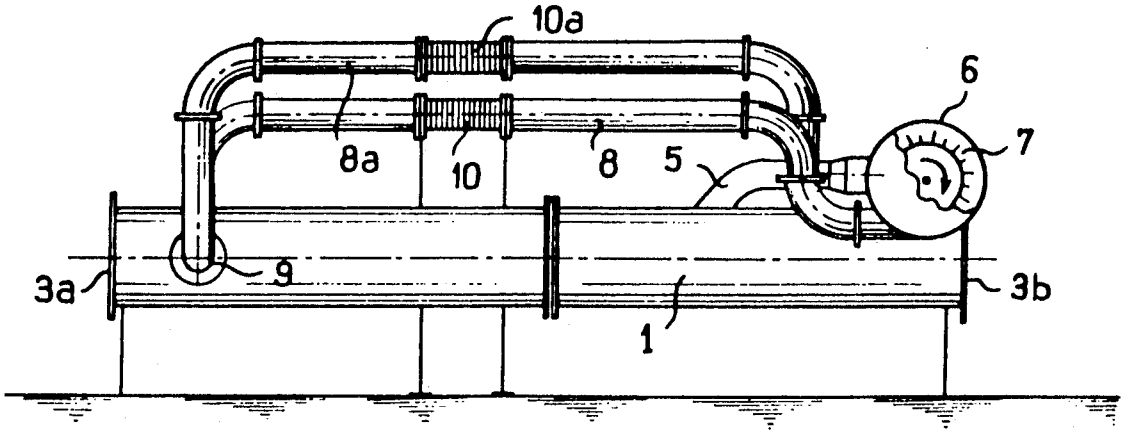

INSTALLATION FOR HEAT-SETTING OF TEXTILE YARNS, HAVING TWO STEAM HEAT-TREATMENT CHAMBERS

The present invention relates to an improved installation for the heat-setting of textile yarns.

Heat-setting is understood to mean a heat treatment in the presence of water vapor, with the intention of heat-setting the fibers constituting a yarn in order to make the latter suitable for the manufacture of carpets or moquettes. The present case essentially concerns carpet yarns generally consisting of polyamide 6, polyamide 66, polyester, polypropylene, wool, or mixed fibers. The heat treatment can be carried out with the aid of hot air containing saturated, wet or superheated steam. Nevertheless, in order to obtain a good heat-setting, saturated steam is the most appropriate treatment fluid.

Depending on the type of fiber to be treated and the desired results, the saturated-steam treatment temperatures can range from approximately 105° C. to 145° C. It is therefore clear that in order to obtain saturated steam at these temperatures, the treatment chambers must operate under pressure.

The known installation, designed by the applicant, for the heat-setting of textile yarns comprises a tubular heating and steam-treatment chamber, partially filled with water and connected at its opposite ends to two tubular cooling chambers, which are themselves closed at their end by a sealing device essentially composed of rubber-coated rollers enabling both all the chambers to be maintained under pressure, and the conveying belt supporting the layer of the yarn to be treated to pass through. These chambers are traversed longitudinally by a moveable belt conveying the yarn to be treated.

This yarn to be treated is deposited in successive parallel circular coils or successive oblong coils perpendicular to the belt, and thus forms a layer which substentially occupies the entire width of this belt.

This belt extends in the cooling chambers substantially in a horizontal diametral plane of these chambers.

In the heating and pressurized steam-treatment chamber, the belt passes above the longitudinal axis of this chamber.

The outer wall of this chamber comprises, near its exit end, a duct opening out, on the one hand, inside the chamber and, on the other, into the compartment of a turbine extracting the steam from the chamber and delivering it into another duct connected to an opening through which the steam delivered by the turbine is reintroduced into the chamber. This arrangement enables the steam inside the chamber to be agitated continuously, which makes it possible to obtain a perfect regularity and homogeneity of the treatment fluid, and hence consequently a perfect regularity in the quality of the treated yarn thus obtained. Indeed, if such an agitation were not to take place, the heat-setting treatment would translate into irregularities which would be visible on textile articles made using such a yarn.

In order to increase productivity, it is, of course, possible to envisage arranging side by side two or more treatment lines functioning independently of each other.

It is, however, in principle very difficult, or even impossible, to operate a plurality of installations of this type under strictly identical conditions.

Indeed, despite the accuracy of the adjustment devices which control these installations, differences in temperature and steam pressure are inevitable, in particular in the heating and steam-treatment chambers.

These differences in treatment conditions translate into differences in the quality of the yarns obtained. Thus, if the yarns obtained by the different installations are mixed, the textile articles obtained using such a mixture of yarns will have visible faults, which is entirely unacceptable.

Because of this deficiency, the yarns obtained by the different installations must be stored separately, which considerably complicates stock management.

The object of the present invention is to overcome this disadvantage.

The subject of the invention is thus an installation for the heat-setting of textile yarns, comprising a heating and pressurized-steam-treatment chamber intended to be traversed longitudinally by a layer of the yarn to be treated, this chamber comprising an entrance and an exit, and an outer wall having, near said exit, a duct opening out, on the one hand, inside said chamber and, on the other hand, into a compartment extracting the steam from the chamber and delivering it into another duct, said outer wall of the chamber comprising, near its entrance, an opening through which the steam delivered by the compartment is reintroduced into said chamber.

This invention is defined, wherein this installation comprises at least one second chamber identical to the first chamber, this second chamber likewise comprising a duct opening out inside this second chamber near its exit and connected to a compartment extracting and delivering the steam from this chamber into a duct, this second chamber furthermore comprising an opening near its entrance, the steam-delivery duct connected to the extraction and delivery compartment of the first chamber being connected to the steam-reintroduction opening situated near the entrance of the second chamber, and the steam-delivery duct connected to the extraction and delivery compartment of the second chamber being connected to the steam-reintroduction opening situated near the entrance of the first chamber.

The steam extracted from inside the first chamber is thus delivered into the second chamber, while the steam extracted from inside the second chamber is delivered into the first chamber.

The water vapors of the two chambers are consequently mixed, which makes it possible to realize identical temperature and pressure conditions in these chambers.

The yarns treated by the two installations will consequently be strictly identical and will thus be capable of being mixed without any disadvantage resulting.

Other features and advantages of the invention will become apparent from the description below.

Figure 3:
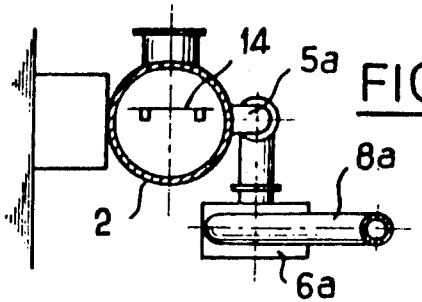
Figure 4:
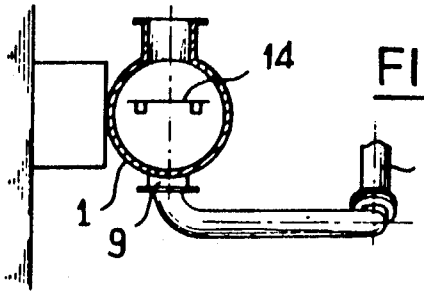
Figure 2:
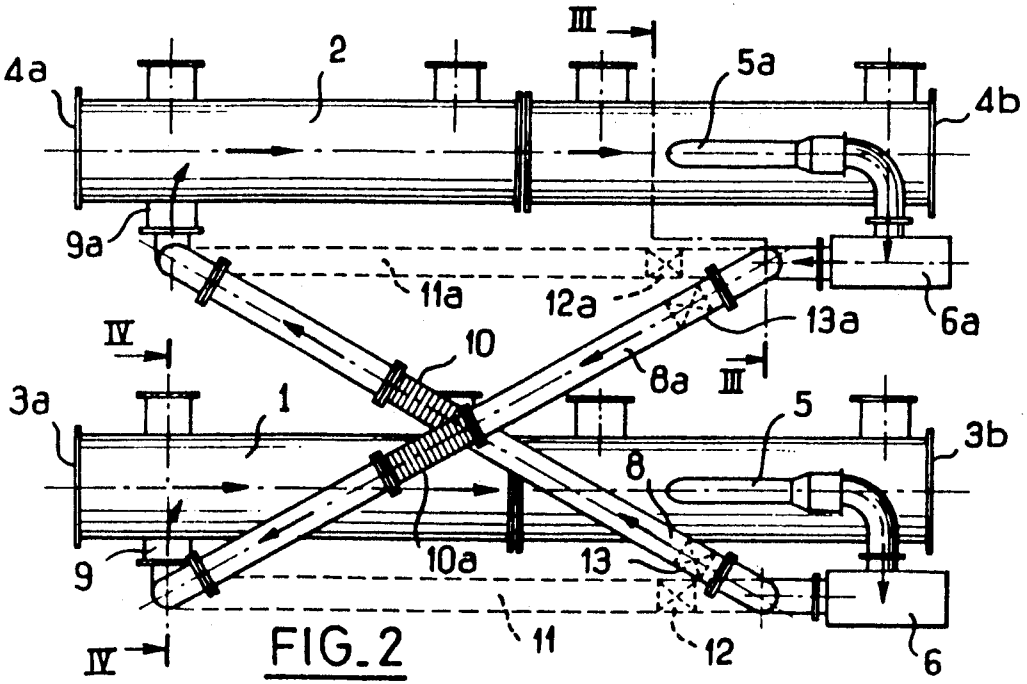

In the attached drawings, given by way of non-limiting examples:

FIG. 1 is a schematic view in elevation of an installation according to the invention, FIG. 2 is a plan view of the two chambers of the installation FIG. 3 is a cross-sectional view along the plane III—III in FIG. 2, and FIG. 4 is a cross-sectional view along the plane IV—IV in FIG. 2.

In the embodiment shown in the attached figures, the installation for the heat-setting of textile yarns comprises two heating and pressurized-steam-treatment chambers 1, 2 arranged parallel to each other and intended to be traversed longitudinally by a layer of the yarn to be treated, supported by a belt 14 (see FIGS. 3 and 4).

Each chamber 1, 2 comprises an entrance 3*a*, 3*b* and an exit 4*a*, 4*b*.

The outer wall of the first chamber 1 comprises, near its exit 3*b*, a duct 5 opening out, on the one hand, inside this chamber 1 and, on the other hand, into the compartment 6 of a rotary turbine 7 extracting the steam from the chamber 1 and delivering it into another duct 8.

The outer wall of the chamber 1 furthermore comprises, near its entrance 3*a*, an opening 9 through which the water vapor delivered by the turbine 7 is reintroduced into this chamber 1.

The second chamber 2 is strictly identical to the first chamber 1.

This second chamber 2 likewise comprises a duct 5*a* opening out inside this second chamber near its exit 4*b* and connected to the compartment 6*a* of a turbine extracting and delivering the water vapor from this chamber 2 into a duct 8*a* identical to the duct 8.

This second chamber 2 furthermore comprises an opening 9*a* near its entrance 4*a*.

Moreover, the steam-delivery duct 8 connected to the compartment 6 of the extraction and delivery turbine 7 of the first chamber 1 is connected to the steam-reintroduction opening 9*a* situated near the entrance 4*a* of the second chamber 2.

Similarly, the steam-delivery duct 8*a* connected to the compartment 6*a* of the extraction and delivery turbine of the second chamber 2 is connected to the steam-reintroduction opening 9 situated near the entrance 3*a* of the first chamber 1.

As a result of the above arrangements, the delivery ducts 8 and 8*a* connecting the chamber 1 to the chamber 2 and vice versa intersect, one above the other, as shown in FIG. 2.

These delivery ducts 8 and 8*a* have bellows 10 and 10*a* enabling the thermal expansions to be absorbed.

The installation which has just been described functions as follows:

The turbine 7 associated with the first chamber 1 extracts the water vapor from this first chamber 1 and delivers it into the duct 8 which reintroduces this water vapor near the entrance 4*a* of the second chamber 2.

Similarly, the turbine associated with the second chamber 2 extracts the water vapor from this chamber and delivers it into the duct 8*a* which reintroduces this water vapor near the entrance 3*a* of the first chamber.

This arrangement ensures an agitation of the water vapor in each chamber 1 and 2 and enables the steam from the two chambers to mix.

This mixture of steam makes it possible to establish strictly identical temperature and pressure conditions in the two chambers 1 and 2.

The yarns treated in these two chambers 1, 2 will thus be heat-set under strictly identical conditions, with the result that their properties and appearance will also be identical.

It will consequently be possible for the yarns treated in the two chambers to be mixed without any risk, given that the articles obtained using such mixed yarns will not contain any visible faults linked to the presence of yarns originating from the two different treatment chambers.

The use of an installation comprising two heating and steam-treatment chambers functioning in parallel thus makes it possible to double the production of treated yarns without this giving rise to the disadvantages indicated above.

It can furthermore be seen in FIG. 2 that, for each chamber 1, 2, a duct 11, 11*a* (shown in dashed lines) connects the exit of the compartment 6, 6*a* enclosing the extraction and delivery turbine associated with each chamber to the opening 9, 9*a* for reintroducing the steam into the corresponding chamber. Moreover, valves 12, 13; 12*a*, 13*a* are provided on the ducts 11, 11*a*; 8, 8*a* to direct the delivered steam either to the steam-reintroduction opening 9, 9*a* of a same chamber, or to that of a different chamber.

This arrangement is useful when only one of the chambers 1 or 2 is functioning.

Thus, in the case where, for example, only the chamber 1 is to function, it is sufficient to close the valve 13 situated on the delivery duct 8 and to open the valve 12 situated on the duct 11 which directly connects the compartment 6 of the turbine to the opening 9 of this chamber 1.

A detailed illustrative embodiment of a heat-setting installation having a single heating and steam-treatment chamber has been described in the patent application of the applicant filed on this day and entitled "Installation for the heat-setting of textile yarns".

Reference should thus be made to the description of this patent application, the contents of which are considered to be incorporated in the present description, if further information is desired on the structure of the installation, and in particular of the treatment chamber.

The invention is not, of course, limited to the illustrative embodiments which have just been described and numerous modifications may be made to them without going beyond the scope of the invention.

I claim:

1. An installation for the heat-setting of textile yarns, comprising a heating and pressurized-steam-treatment chamber (1) intended to be traversed longitudinally by a conveying belt supporting a layer of the yarn to be treated, this chamber (1) comprising an entrance (3*a*) and an exit (3*b*), and an outer wall having, near said exit (3*b*), a duct (5) opening out, on the one hand, into a compartment (6) extracting the steam from the chamber and delivering it into another duct (8), said outer wall of the chamber (1) comprising, near its entrance (3*a*), an opening (9) through which the steam delivered by the compartment (6) is reintroduced into said chamber, wherein the installation comprises at least one second chamber (2) identical to the first chamber (1), this second chamber (2) likewise comprising a duct (5*a*) opening out inside this second chamber (2) near its exit (4*b*) and connected to a compartment (6*a*) extracting and delivering the steam from this chamber into a duct (8*a*), this second chamber (2) furthermore comprising an opening (9*a*) near its entrance (4*a*), wherein the steam-delivery duct (8) connected to the extraction and delivery compartment (6) of the first chamber (1) is connected to the steam-reintroduction opening (9*a*) situated near the entrance (4*a*) of the second chamber (2), and wherein the steam-delivery duct (8*a*) connected to the extraction and delivery compartment (6*a*) of the second chamber (2) is connected to the steam-reintroduction opening (9) situated near the entrance of the first chamber (1).

2. The installation as claimed in claim 1, wherein, furthermore, for each chamber (1, 2), a duct (11, 11*a*) connects the exit of the extraction and delivery compartment (6, 6*a*) associated with each chamber to the opening for reintroducing steam into the same chamber, valves (12, 13; 12*a*, 13*a*) being provided on said ducts (8, 8*a*; 11, 11*a*) to direct the delivered steam either to the steam-reintroduction opening of the same chamber, or to that of a different chamber.

3. The installation as claimed in claim 1 wherein the two chambers (1, 2) are arranged substantially parallel to each other.

* * * * *